US010244857B2

(12) United States Patent
Nelson et al.

(10) Patent No.: US 10,244,857 B2
(45) Date of Patent: Apr. 2, 2019

(54) ORAL CARE IMPLEMENT AND FILAMENT FOR THE SAME

(71) Applicant: COLGATE-PALMOLIVE COMPANY, New York, NY (US)

(72) Inventors: Stephen Nelson, New Brunswick, NJ (US); Alan V. Sorrentino, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 284 days.

(21) Appl. No.: 15/250,497

(22) Filed: Aug. 29, 2016

(65) Prior Publication Data

US 2018/0055206 A1 Mar. 1, 2018

(51) Int. Cl.

| | |
|---|---|
| ***A46B 9/04*** | (2006.01) |
| ***A46B 9/02*** | (2006.01) |
| ***A46D 1/05*** | (2006.01) |
| ***A46D 1/00*** | (2006.01) |

(52) U.S. Cl.

CPC ..... *A46B 9/04* (2013.01); *A46B 9/028* (2013.01); *A46D 1/0261* (2013.01); *A46D 1/0276* (2013.01); *A46D 1/05* (2013.01); *A46B 2200/1066* (2013.01)

(58) Field of Classification Search

CPC ... A46B 5/04; A46B 9/028; A46B 2200/1066; A46D 1/0261; A46D 1/0276; A46D 1/05; A46D 1/00

See application file for complete search history.

(56) References Cited

U.S. PATENT DOCUMENTS

| | | | |
|---|---|---|---|
| 5,533,227 | A | 7/1996 | Ito et al. |
| 6,067,684 | A | 5/2000 | Kweon |
| 6,088,869 | A | 7/2000 | Kaneda et al. |
| 6,090,488 | A | 7/2000 | Kweon |
| 6,764,142 | B2 | 4/2004 | Kwon |
| 7,134,162 | B2 | 11/2006 | Kweon et al. |
| 7,448,693 | B2 | 11/2008 | Kwon et al. |
| 7,832,811 | B2 | 11/2010 | Kwon et al. |
| 7,938,492 | B2 | 5/2011 | Kwon et al. |
| 8,029,069 | B2 | 10/2011 | Kwon et al. |
| 8,136,889 | B2 | 3/2012 | Kwon et al. |

(Continued)

FOREIGN PATENT DOCUMENTS

| | | |
|---|---|---|
| EP | 0959717 | 3/2003 |
| JP | 2009136509 | 6/2009 |

(Continued)

OTHER PUBLICATIONS

International Search Report and Written Opinion of the International Searching Authority in International Application No. PCT/US2017/048803, dated Nov. 2, 2017.

*Primary Examiner* — Dung Van Nguyen

(57) ABSTRACT

A mechanically tapered bristle filament for an oral care implement. The filament is characterized by a long thin tapered end portion. The tapered end portion has a taper length and tip diameter comparable to chemically tapered filaments. The areal surface roughness of the tapered end portion however is greater than chemically tapered filaments thereby producing increased scrubbing action against the surfaces of the teeth. The foregoing taper and roughness characteristics of the present filament enhance inter-dental cleaning effectiveness.

18 Claims, 2 Drawing Sheets

(56) References Cited

U.S. PATENT DOCUMENTS

| | | | | |
|---|---|---|---|---|
| 8,172,337 | B2 * | 5/2012 | Kwon | A46D 1/05 300/21 |
| 8,186,765 | B2 | 5/2012 | Kwon et al. | |
| 8,336,967 | B2 | 12/2012 | Kwon et al. | |
| 8,403,425 | B2 | 3/2013 | Kwon et al. | |
| 8,424,145 | B2 | 4/2013 | Kwon et al. | |
| 8,522,389 | B2 * | 9/2013 | Kwon | A46D 1/0276 15/167.1 |
| 8,918,945 | B2 | 12/2014 | Kwon et al. | |
| 2002/0116778 | A1 | 8/2002 | Kwon | |
| 2004/0103492 | A1 * | 6/2004 | Kwon | A46B 3/04 15/167.1 |
| 2008/0028558 | A1 | 2/2008 | Kwon | |
| 2011/0233988 | A1 | 9/2011 | Kwon et al. | |
| 2012/0272469 | A1 | 11/2012 | Kwon et al. | |
| 2013/0291326 | A1 * | 11/2013 | Mintel | A46B 9/04 15/167.1 |
| 2013/0318732 | A1 * | 12/2013 | Mintel | A46B 9/04 15/167.1 |
| 2016/0015163 | A1 * | 1/2016 | Newman | A46B 9/06 15/167.1 |
| 2017/0065070 | A1 * | 3/2017 | Hohlbein | A46B 9/04 |
| 2017/0127818 | A1 * | 5/2017 | Wagstaff | A46D 1/0276 |
| 2017/0245628 | A1 * | 8/2017 | Xi | A46D 1/006 |
| 2018/0192766 | A1 * | 7/2018 | Xi | A46D 1/023 |

FOREIGN PATENT DOCUMENTS

| | | |
|---|---|---|
| KR | 20000067623 | 11/2000 |
| KR | 20040050699 | 6/2004 |
| KR | 20040101127 | 12/2004 |
| KR | 20040105499 | 12/2004 |
| KR | 20050108634 | 11/2005 |
| KR | 20100055844 | 5/2010 |
| KR | 20110014352 | 2/2011 |
| KR | 20110131964 | 12/2011 |
| WO | WO2004113047 | 12/2004 |
| WO | WO2005087045 | 9/2005 |
| WO | WO2006101286 | 9/2006 |
| WO | 2007000922 | 1/2007 |

* cited by examiner

ORAL CARE IMPLEMENT AND FILAMENT FOR THE SAME

BACKGROUND

Tapered filaments for oral care implement bristles have been widely used in the toothbrush market for many years. Most of these tapered filaments are processed chemically and provide a slim needle-like tip that allows them to clean better in-between teeth and at the gum line, as well as providing a superior softer mouth feel for users. The problem is that these filaments are relatively expensive, the chemical immersion process is difficult to manage, and there are limitations on the filament materials that can be used as well as the available taper profile shape. For example, filaments made of nylon are generally not amendable to chemical tapering which is typically employed for filaments comprised of PBT (Polybutylene Terephthalate). Nylon however is preferred by some users over PBT for its greater softness and flexibility. Mechanical tapering or end rounding (see, e.g. FIG. 1) if used regardless of the filament material cannot generally replicate the same slim tip diameters and long tapered lengths as their chemically processed counterparts associated with inter-dental cleaning effectiveness and softness. On the other hand, mechanical processing produces greater surface roughness in the processed area of filaments which is a desirable feature for inter-dental cleaning effectiveness. Thus there is a need for mechanically tapered filaments with slim tips and long taper lengths like chemically tapered filaments but with the higher surface roughness benefits of mechanically processed filaments.

BRIEF SUMMARY

The present invention provides a tooth cleaning filament which advantageously possesses the desirable long taper length and small tip diameters of chemically processed filaments characterized by a needle-like profile, and greater tip area surface roughness of mechanically processed filaments. In one embodiment, this filament may be produced by mechanical tapering. The filament may be used as a bristle incorporated into an oral care implement, such as without limitation a toothbrush.

In one aspect, the invention may be a filament for an oral care implement comprising: an elongated shaft terminating in a tip and having a tapered end portion; a taper length of 5 mm or more measured in the tapered end portion; and an areal surface roughness value of at least 0.20.

In another aspect, the invention may be a mechanically tapered filament for an oral care implement comprising: an elongated shaft terminating in a tip and having a mechanically tapered end portion; a taper length of 5 mm or more measured in the tapered end portion; a tip diameter of less than 10 microns measured at 0.05 mm from the tip in the tapered end portion; and an areal surface roughness value of at least 0.20.

In another aspect, the invention may be an oral care implement comprising: a handle; a head supported by the handle; and a plurality of tooth cleaning elements extending from the head, the plurality of tooth cleaning elements comprising mechanically tapered bristle filaments; the filaments each including an elongated shaft terminating in a tip and having a tapered end portion, a taper length of 5 mm or more measured in the tapered end portion, and an areal surface roughness value of at least 0.20.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
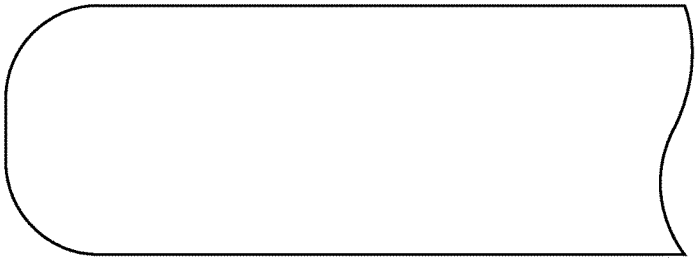
FIG. 1 (PRIOR ART)
FIG. 1 is a known mechanically end-rounded bristle filament.

All drawing are schematic and not necessarily to scale.

DETAILED DESCRIPTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The present disclosure relates to bristle filaments that are mechanically tapered resulting in a profile and dimensions comparable to the small tip diameters and long taper lengths of chemically tapered filaments; unlike existing mechanically end-rounded filaments in the market. The mechanical process typically is applied before tufting to attach the filaments to the head of an oral care implement such as a toothbrush, but these filaments can be mechanically tapered either before or after tufting in various embodiments. Filaments can be tapered on either one side or one both sides. The opposing other end would be end-rounded. The pre-processed bristle filament can have circular, rectangular, or special shape cross sections.

Desirable characteristics of a tapered bristle filament for inter-dental cleaning effectiveness can be equated primarily to three characteristics or parameters: (1) small tip diameters; (2) long taper lengths; and (3) high surface roughness. The former two parameters allow the filament to reach effectively between the teeth, while high values of roughness facilitates inter-dental debris removal via improved scrubbing action against the teeth.

Figure 2:
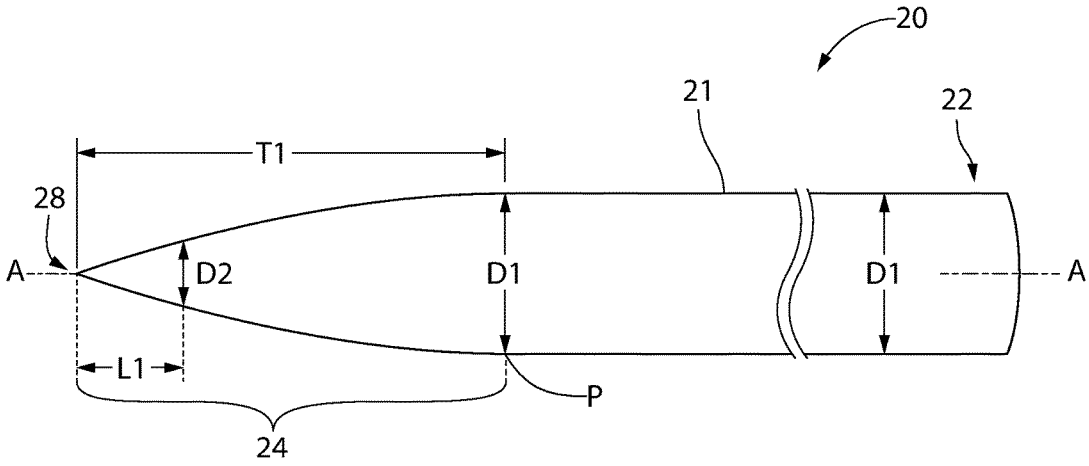
FIG. 2 is a mechanically tapered bristle filament according to the present disclosure.

FIG. 2 depicts a filament 20 according to the present disclosure. Filament 20 comprises longitudinal axis A-A, an elongated shaft 21 of diameter D1. The shaft includes a mounting end portion 22 for attachment to a tooth cleaning implement, and an opposite tapered end portion 24 configured for inter-dental cleaning. The mounting end portion 22 may therefore also be considered the proximal end of the filament and tapered end portion 24 may be considered the distal end in other nomenclature. Mounting end portion 22 may be generally cylindrical in shape with a circular cross section in some embodiments, and in other embodiments may have asymmetrical or other polygonal and non-polygonal cross sectional shapes as some non-limiting examples. The cross sectional shape does not limit the invention. The mounting end portion 22 may have the same diameter D1 as the base filament material provided. It will be appreciated that non-circular shapes may be equated with a diameter D1 formed by an imaginary circle which may be drawn to circumscribe such shapes.

Tapered end portion 24 defines a terminal end or tip 28. Tip 28 may be pointed or have other shapes included a slightly rounded profile or flat end surface. Tapered end portion 24 has a somewhat gradually reducing diameter in moving from the mounting end 22 towards tip 28 of the filament. Accordingly, the tapered end portion 24 has progressively smaller diameters each being less than diameter D1 of the base filament material and culminates in tip 28. The tapered end portion 24 has a taper length T1 characterized by the length of filament 20 having diameters smaller than diameter D1. T1 is therefore measured from the tip 28 to the point P on the filament shaft 21 where the full diameter D1 of the shaft originates.

In some examples, without limitation, taper length T1 may be 5 mm or more to form a long taper length which is comparable to chemically tapered filaments, but contrasts to significantly shorter taper lengths of known mechanically end-rounded bristle filaments (see, e.g. FIG. 1). In some embodiments, the taper length T1 may be between and including 5 to 7 mm. The bristle filament 20 preferably has a tip diameter D2 measured at a distance L=0.5 mm from tip 28 which is less than 0.01 mm (or 10 microns) which characterizes the long thin tapered ends of bristle filaments that are produced via chemical tapering processes. When a group of bristle filaments are measured, preferably the group has an average tip diameter D2 less than 0.01 mm.

Preferably, filament 20 is mechanically processed or tapered to produce tapered end portion 24. Advantageously, this not only produces a taper length and small tip diameters as chemically processed or dipped bristle filaments for inter-dental cleaning effectiveness, but further beneficially imparts the highly desirable attribute of greater surface roughness resulting from the mechanically tapering process which is equated with enhanced tooth surface cleaning performance. By contrast, chemically dipped bristles typically immersed for a period of time in a corrosive bath produce smooth bristle surfaces which are not conducive for improved scrubbing action on the teeth. The mechanical tapering process may comprise applying a grinding, filing, and/or cutting mechanism or tool to the filament which removes base material from the filament to produce the tapered end portion 24 having the dimensions and characteristics described herein.

Example 1

Mechanically tapered bristle filaments were produced according to the present disclosure. Measurements on samples were performed using confocal and scanning electron microscopes to obtain taper data on the tapered end portion 24. In one sample measured, the tip diameter D2 of the tapered end portion 24 (measured at 0.05 mm from the tip) was 9.793 microns. This compared favorably to a comparative sample of a chemically tapered filament which had a tip diameter D2 of 9.430 microns; both the sample and comparative sample falling below the desired 10 micron diametrical limit or threshold which characterizes long and thin tapered bristle ends. In a group of five mechanically tapered bristle filaments produced according to the present disclosure, the group exhibited an average tip diameter D2 of 9.6 microns.

Additional diametrical measurements recorded for the tapered end portion 24 of the foregoing sample produced according to the present disclosure were 8.352 microns diameter @ 0.01 mm from tip and 7.741 microns diameter @ 0.02 mm from tip. These values similarly were below the target of 10 microns in diameter.

Example 2

As already noted herein, an additional desirable characteristic equated with improved inter-dental cleaning effectives is the roughness of the surface in the tapered end portion of a bristle filament which performs the inter-dental cleaning. Tests were conducted for samples of bristle filaments tapered via mechanical processing according to the present disclosure and comparative samples of bristle filaments tapered via chemical processing. Surface roughness was measured using a non-contact 3D surface profiler based on scanning white-light and phase shifting interferometry to determine areal three-dimensional roughness Sa. Four filaments each were measured for both the mechanically and chemically tapered groups of samples.

The test results indicated that the mechanically tapered bristles according to the present disclosure had an average surface roughness Sa value of 0.68 at 4 mm from the tip and 0.09 at 7 mm from the tip; the higher value representing a rougher surface profile. The 4 mm measurement falls within the processed tapered end portion of the filament whereas the 7 mm measurement represents the unprocessed base filament material just beyond the mechanically processed taper length by comparison.

By contrast, the chemically tapered bristles had an average surface roughness Sa value of 0.15 at 4 mm from the tip and 0.07 at 7 mm from the tip. These values represent a relatively smooth un-roughened filament surface even in the processed tapered area at 4 mm. Accordingly, the mechanically tapered bristle filaments 20 produced according to the present disclosure advantageously exhibited a higher surface roughness in the tapered end portion of the filament while simultaneously possessing the desirable long and thin tapered end portions comparable to chemically processes bristle filaments. The present bristle filament 20 therefore exhibits the best characteristics of both the mechanical end rounding and chemically tapered filaments associated with improved inter-dental cleaning effectiveness.

Based on the foregoing, mechanically tapered bristle filaments produced according to the present disclosure preferably have an areal surface roughness Sa value measured in the tapered end portion 24 that exceeds the roughness of a chemically tapered filament described above having similar taper lengths and diameters. The areal surface roughness Sa value measured in the tapered end portion 24 of the mechanically tapered filaments is therefore preferably at least 0.20, and more preferably at least 0.50.

One way to quantify the foregoing three characteristics associated with tapered bristle filaments and inter-dental cleaning effectiveness is via using an equation defined as the Nelson Ratio (Ω) represented by the expression:

$$\text{Nelson Ratio } (\Omega) = \frac{1}{6.458}\left(\left(\frac{\lambda_R}{3}\right) + (6\theta_R) + \left(\frac{\phi_R}{8}\right)\right)$$

where:

$$\lambda_R = \text{Taper Length Ratio} = \frac{\lambda_{Actual}}{\lambda_{Target}}$$

$\lambda_{Actual}$=Measured Taper Length $\lambda_{Target}$=Target Taper Length

Based on Length of Taper; measured in mm $$\theta_R = \text{Tip Diameter Ratio} = \frac{\theta_{Actual}}{\theta_{Target}}$$

$\theta_{Actual}$=(Base Diameter)−(Measured Tapered Tip Diameter)

$\theta_{Target}$=(Base Diameter)−(Target Tapered Tip Diameter{0.01 mm})

Based on Tip diameter at 0.05 mm measured in mm $$\phi_R = \text{Roughness Ratio} = \frac{\phi_{Actual}}{\phi_{Target}}$$

$\phi_{Actual}=S_a\text{tip}-S_a\text{base}=\Delta S_{Actual}$ $\phi_{Target}=S_a\text{tip}-S_a\text{base}=\Delta S_{Target}$ Based on surface roughness $S_a$ (RMS) at the "tip" and "body" (in this case measured at 4 mm and 7 mm from tip respectively). Measured in micron.

The Nelson ratio essentially compares a target or spec tip diameter, taper length, and surface roughness to corresponding actual values for the end product filament produced by a tapering process. The desired Nelson ratio therefore for an ideal bristle filament which matches the target specification in all three values is therefore preferably at least "1." Nelson Ratio values for the mechanically tapered filament sets produced according to the present disclosure that match chemically tapered performance for inter-dental cleaning effectiveness have been shown via measurement to be between 0.8 to 1.20 for each filament, and in non-limiting preferred embodiments to fall between 0.980 and 1.10 for each filament By contrast, prior known chemically tapered and mechanically rounded filament sets have Nelson Ratio values that have been shown to fall between 0.00 to 0.998, but there were some data point exceptions outside of this range. Where the filaments 20 are incorporated into an oral care implement, a plurality of filaments attached to the oral care implement may have an average Nelson Ratio for a group of filaments between the foregoing ranges of between 0.8 to 1.20, and more preferably 0.980 and 1.10. In one non-limiting embodiment, the target tapered tip diameter is 0.01 mm. The targets for the taper length and surface roughness may be 7 mm and 0.68 micron, respectively.

In a preferred embodiment, the mechanically tapered filament material used may be nylon. However, in other embodiments different bristle filament materials may be used which have a mechanically processed tapered end portion with characteristics according to the present disclosure such as without limitation PBT, PET (polyethylene terephthalate), and others suitable for use in an oral care implement. Accordingly, the invention is not limited to the use of nylon alone for bristle filaments.

Figure 3:
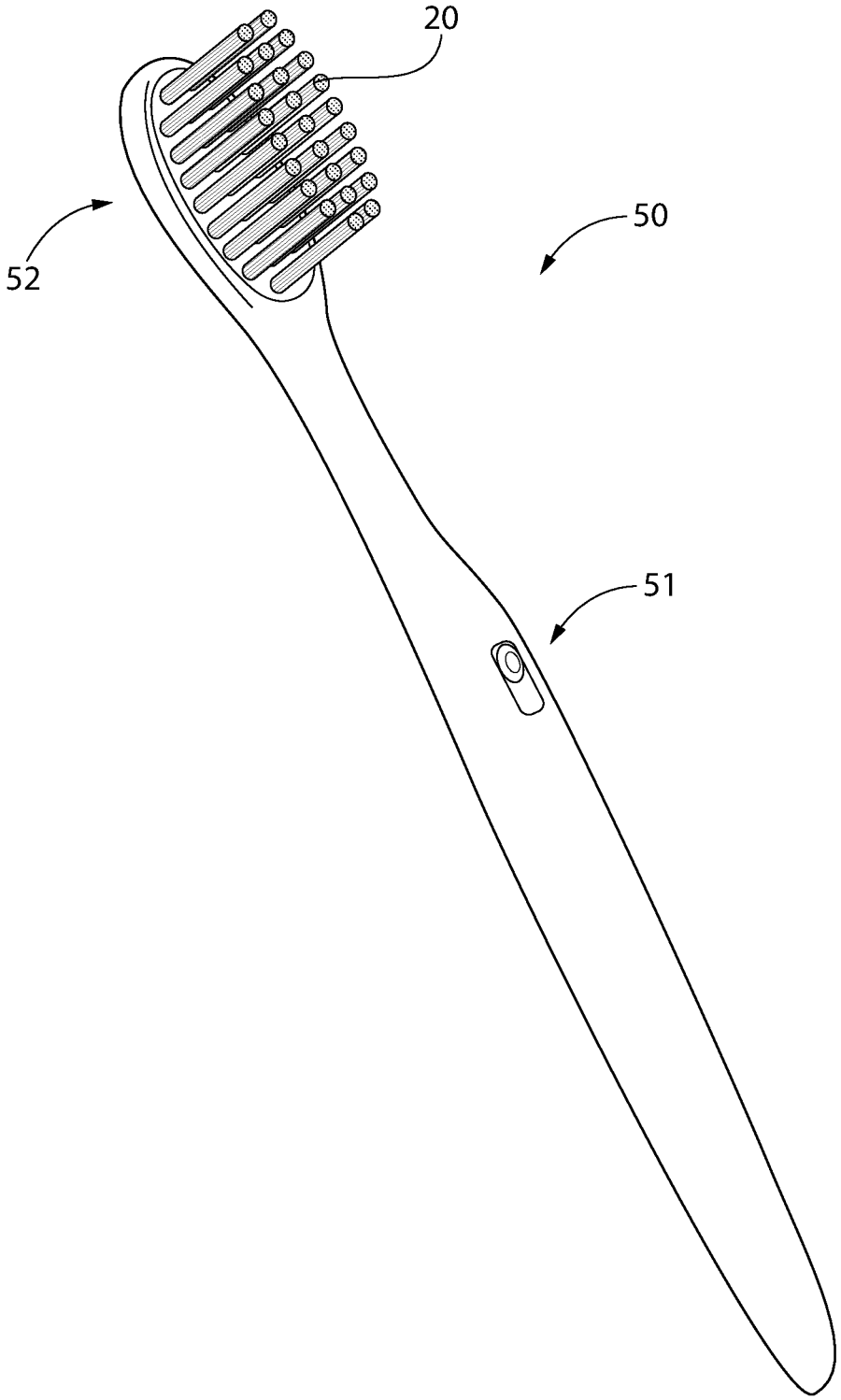
FIG. 3 is an oral care implement incorporating the filament of FIG. 2.

The mechanically tapered filament 20 may be incorporated into any suitable type of oral care implement, such as a manual or electric toothbrush 50 shown in FIG. 3. Toothbrush 50 generally includes a handle 51 and head 52 supported by the handle. The bristle filaments 20 may be attached to the head of such a toothbrush by any suitable means including anchor free tufting (AFT). The securement method does not limit the invention. Filament 20 may be employed entirely as the sole tooth cleaning element used in the brush, or form at least some of the bristle tufts, or be mixed in combination with other types of bristle filaments and/or elastomeric elements on the interior and/or peripheral regions of the toothbrush head. In some embodiments, the filaments 20 may be disposed in the peripheral regions of the toothbrush head for positioning near the gum and teeth interface during brushing.

Although the mechanically tapered filament 20 has been described with application to an oral care implement, it will be appreciated that other applications may employ the bristle filament. For example, without limitation, the filament 20 may be used for cosmetic brushes, paint brushes, hair brushes, general purpose brushes, cleaning brushes, and other applications form a bristle filament having the characteristics described herein. The end use is therefore not necessarily limiting of the invention.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A mechanically tapered filament for an oral care implement, the filament comprising:

an elongated shaft terminating in a tip and having a mounting end portion of constant cross section and a tapered end portion;

wherein the tapered end portion has a taper length of 5 mm or more;

wherein the tapered end portion has an areal surface roughness value of at least 0.20; and wherein the filament has a Nelson Ratio between 0.8 to 1.20.

2. The filament according to claim 1, wherein the filament has a tip diameter of less than 10 microns measured at 0.05 mm from the tip in the tapered end portion.

3. The filament according to claim 1, wherein the areal surface roughness value is at least 0.50.

4. The filament according to claim 1, wherein the filament is formed of nylon.

5. The filament according to claim 1, wherein the diameter between the tip and 0.05 mm from the tip is less than 10 microns.

6. An oral care implement comprising:

a handle;

a head supported by the handle; and a plurality of tooth cleaning elements extending from the head, wherein at least one of the tooth cleaning elements is the mechanically tapered filament according to claim 1.

7. The oral care implement according to claim 6, wherein all of the tooth cleaning elements comprise the mechanically tapered filament.

8. The oral care implement according to claim 6, wherein only a portion of the tooth cleaning elements comprise the mechanically tapered filament.

9. The oral care implement according to claim 6, wherein the mechanically tapered filaments comprise at least some of peripheral bristle tufts on the head.

10. A mechanically tapered filament for an oral care implement, the filament comprising:

an elongated shaft terminating in a tip and having a mounting end portion of constant cross section and a mechanically tapered end portion;

the tapered end portion having a taper length of 5 mm or more;

the tapered end portion having a tip diameter of less than 10 microns measured at 0.05 mm from the tip; and the tapered end portion having an areal surface roughness value of at least 0.20; and wherein the filament has a Nelson Ratio between 0.8 to 1.20.

11. The filament according to claim 10, wherein the areal surface roughness value is at least 0.50.

12. The filament according to claim 10, wherein the filament is formed of nylon.

13. The filament according to claim 10, wherein the diameter between the tip and 0.05 mm from the tip is less than 10 microns.

14. A mechanically tapered filament comprising:

an elongated shaft terminating in a tip and having a mechanically tapered end portion, the tapered end portion having a Nelson Ratio between 0.8 to 1.20, wherein the Nelson Ratio is defined by the formula:

$$\text{Nelson Ratio } (\Omega) = \frac{1}{6.458}\left(\left(\frac{\lambda_R}{3}\right) + (6\theta_R) + \left(\frac{\phi_R}{8}\right)\right)$$

wherein $$\lambda R = \text{Taper Length Ratio} = \frac{\lambda Actual}{\lambda Target} = \frac{\text{Measured Taper Length}}{\text{Target Taper Length}},$$

measured in millimeters;

wherein $$\theta R = \text{Tip Diameter Ratio} = \frac{\theta Actual}{\theta Target} = \frac{\text{Base Diameter} - \text{Measured Tapered Tip Diameter}}{\text{Base Diameter} - \text{Target Tapered Tip Diameter}},$$

wherein the measured and target tapered tip diameters are measured at 0.05 millimeters from the tip; and wherein $$\phi R = \text{Roughness Ratio} = \frac{\phi Actual}{\phi Target} = \frac{Sa\ \text{tip actual} - Sa\ \text{base}}{Sa\ \text{tip target} - Sa\ \text{base}},$$

wherein Sa is areal surface roughness, wherein Sa tip actual and Sa tip target are measured at 4 millimeters from the tip and is at least 0.2, and wherein Sa base is measured at 7 mm from the tip.

15. The filament according to claim 14, wherein the tapered end portion has a taper length of 5 mm or more.

16. The filament according to claim 14, wherein the areal surface roughness value is at least 0.50.

17. The filament according to claim 14, wherein the target tapered tip diameter is 0.01 mm.

18. The filament according to claim 14, wherein the filament is formed of nylon.

* * * * *